US009700121B2

(12) United States Patent
Defert et al.

(10) Patent No.: US 9,700,121 B2
(45) Date of Patent: Jul. 11, 2017

(54) CONNECTION DEVICE BETWEEN A DISTRIBUTOR HEAD AND A COSMETIC PRODUCT APPLICATOR, HEAD COMPRISING SUCH A DEVICE, TUBE COMPRISING SUCH A HEAD AND ASSOCIATED APPLICATOR

(71) Applicant: Albea Services, Gennevilliers (FR)

(72) Inventors: Sylvain Defert, Saint Ouen l'Aumone (FR); Yann Crapet, Pontoise (FR)

(73) Assignee: ALBEA SERVICES, Gennevilliers (FR)

( * ) Notice: Subject to any disclaimer, the term of this patent is extended or adjusted under 35 U.S.C. 154(b) by 59 days.

(21) Appl. No.: 14/804,511

(22) Filed: Jul. 21, 2015

(65) Prior Publication Data

US 2016/0029772 A1 Feb. 4, 2016

(30) Foreign Application Priority Data

Jul. 29, 2014 (FR) ..... 14 57317

(51) Int. Cl.

| | |
|---|---|
| ***B43K 1/06*** | (2006.01) |
| ***A45D 40/26*** | (2006.01) |
| ***A45D 34/04*** | (2006.01) |
| *B05C 17/035* | (2006.01) |

(52) U.S. Cl.

CPC ..... *A45D 40/26* (2013.01); *A45D 34/04* (2013.01); *A45D 34/041* (2013.01); *A45D 40/261* (2013.01); *A45D 2200/10* (2013.01); *B05C 17/0357* (2013.01)

(58) Field of Classification Search

CPC ..... A45D 34/04; A45D 34/041; A45D 40/26; A45D 40/261; A45D 2200/10

USPC ..... 401/265

See application file for complete search history.

(56) References Cited

U.S. PATENT DOCUMENTS 4,359,292 A * 11/1982 Thompson ..... B65D 47/42 401/213

FOREIGN PATENT DOCUMENTS

WO 80/02261 10/1980

OTHER PUBLICATIONS

French Application1457317, International Search Report, dated Apr. 17, 2015.

* cited by examiner

*Primary Examiner* — Jennifer C Chiang
(74) *Attorney, Agent, or Firm* — Banner & Witcoff, Ltd.

(57) ABSTRACT

A connection device between a distributor head for cosmetic product and a cosmetic product applicator, the device comprising a part for fixing to said distributor head. The fixing part being configured to be immovable relative to said distributor head, and a part movable relative to said fixing part. The device further comprising a connection zone between the fixing part and the movable part, said connection zone being configured so that said movable part is movable in rotation about at least two axes (X, Y, Z) of a orthonormal coordinate system (X, Y, Z) relative to said fixing part. An applicator head comprising such a connection device, a tube comprising such an applicator head and an associated applicator.

10 Claims, 3 Drawing Sheets

CONNECTION DEVICE BETWEEN A DISTRIBUTOR HEAD AND A COSMETIC PRODUCT APPLICATOR, HEAD COMPRISING SUCH A DEVICE, TUBE COMPRISING SUCH A HEAD AND ASSOCIATED APPLICATOR

CROSS REFERENCE TO RELATED APPLICATION

This application claims priority to French Application Serial No. 14/57,317, filed Jul. 29, 2014, which is hereby incorporated by reference in its entirety.

FIELD

The invention relates to a connection device between a distributor head for cosmetic product and a cosmetic product applicator, an applicator head comprising such a connection device, a tube comprising such an applicator head and an applicator for such an applicator head.

BACKGROUND

It is known, in the cosmetics field, to provide cosmetic product containers in the form of tubes. These tubes are connected to applicator heads enabling the cosmetic product to be delivered. Said applicator heads are generally provided with applicator surfaces that a user can place directly on the skin.

Said applicator surfaces thus form cosmetic product applicators whose feel varies, depending on the requirements. For example, it is known to produce them with a given orientation relative to the distributor head so as to predetermine the direction of delivery of the cosmetic product.

Known applicators have the disadvantage of segmenting the group of people for whom the tube heads, and therefore the tubes equipped with said heads, are intended, in particular by their predetermined orientation.

SUMMARY

The aim of the invention is to propose an alternative to known applicator heads, in particular by enabling them to adapt to a large group of users.

The invention therefore relates to a connection device between a distributor head for cosmetic product and a cosmetic product applicator, said device comprising a part for fixing to said distributor head, said fixing part being configured to be immovable relative to said distributor head.

According to the invention, said connection device also comprises a part movable relative to said fixing part, said device further comprising a connection zone between the fixing part and the movable part, said connection zone being configured so that said movable part is movable in rotation about at least two axes of a orthonormal coordinate system relative to said fixing part.

The device of the invention makes it possible to introduce some mobility inside an applicator head, in particular between a distributor head and an applicator surface, here called an applicator. Said device thus makes it possible to adapt the orientation of said applicator according to the users. Said device will thus be able to form a standard part that can be associated with different types of applicator depending on the target market.

According to an aspect of the invention, said movable part is configured to allow reversible fitting of the applicator.

Said reversible fitting has the advantage of easy fitting in the factory, particularly when the fitting is performed manually. Said fitting also has the advantage of a possible change of applicator by the user, which further adds to the possibilities of adaptation offered by the invention, for example by using applicators with varied surface finishes. Another advantage of reversible fitting of the applicator is that it can be washed.

According to different embodiments of the invention, which can be taken together or separately:

- said connection device comprises a longitudinal axis of extension;
- said fixing part is situated along the length of said longitudinal axis of extension;
- said connection zone is radially situated between the fixing part and the movable part;
- said movable part is capable of occupying a first position, known as the rest position, and a second position, known as the working position, relative to said fixing part;
- said connection zone comprises a return means configured to exert a restoring force on said movable part in such a way as to bring it back from the working position towards the rest position;
- said return means comprises at least one connector arm having two ends, the first of said ends being connected to the fixing part and the second end being connected to the movable part;
- said connector arm is elastically deformable;
- said return means takes the form of three lamellar arms positioned in a spiral between the fixing part and the movable part;
- the fixing part has an opening for passage of the product;
- said fixing part comprises a shaft for insertion of a conduit for passage of said product;
- said movable part is configured to allow locking of the applicator;
- the fixing part, the movable part and the connection zone are made in a single part, known as the articulation part;
- said articulation part is a moulded part;
- said articulation part comprises some plastic;
- said articulation part comprises a deformable hemispherical envelope.

The invention further relates to an applicator head for cosmetic product comprising a distributor head, an applicator and a device as described above.

According to different embodiments of the invention, which can be taken together or separately:

- said conduit for passage of the product is integrated into said distributor head;
- the applicator head according to the invention, in particular its distributor head, comprises a base and, possibly, an opening/closing ring movable in relation to said base;
- said base has a recess capable of guiding said articulation device, in particular by shape cooperation;
- said ring is capable of occupying a first position, known as the closed position, and a second position, known as the open position, said ring being configured to block the passage of the cosmetic product through said distributor head in the closed position and to allow the passage of said product through said distributor head in the open position;
- said ring is capable of being fitted to a neck of a tube intended to contain the cosmetic product;

said applicator has at least one shape, said movable part has at least one counter-shape, said shape and counter-shape being capable of cooperating together.

The invention further relates to a tube for cosmetic product comprising an applicator head as described above.

The invention also relates to an applicator for an applicator head as described above, said applicator being configured to be fitted reversibly on said connection device.

According to different embodiments of the invention, which can be taken together or separately:

said applicator comprises an opening for passage of the product;

said applicator is a moulded part;

said applicator comprises some plastic.

BRIEF DESCRIPTION OF THE DRAWINGS

The invention will be better understood, and its other aims, details, features and advantages will become more clearly apparent on reading the detailed explanatory description that follows, of at least one embodiment of the invention given as a purely illustrative and non-restrictive example, with reference to the accompanying diagrammatic drawings.

DETAILED DESCRIPTION

Figure 1:
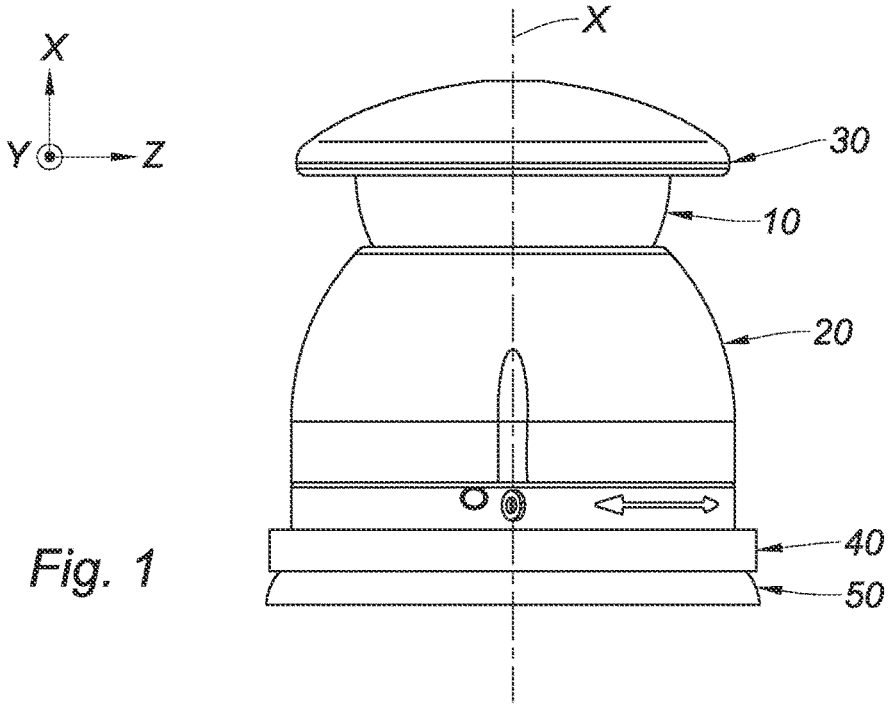
FIG. 1 is an elevated view of an embodiment of an applicator head according to the invention.
Figure 2:
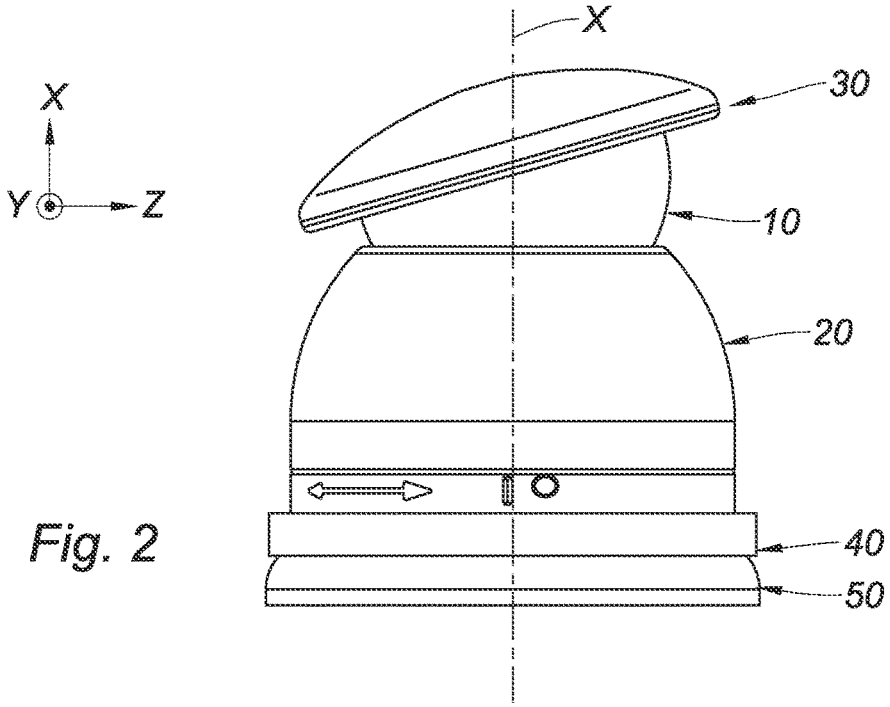
FIG. 2 is the same view as FIG. 1, said applicator head being in a different configuration.

FIGS. 1 and 2 show a connection device 10 between a distributor head for cosmetic product and an applicator 30 of cosmetic product.

"Distributor head" means a head adapted to be fixed to a tube, in particular to a tube head. Said tube, here referenced 50, is intended to receive cosmetic product. The distributor head comprises a base 20, here fixed to the tube 50 via an opening/closing ring 40.

Figure 5:
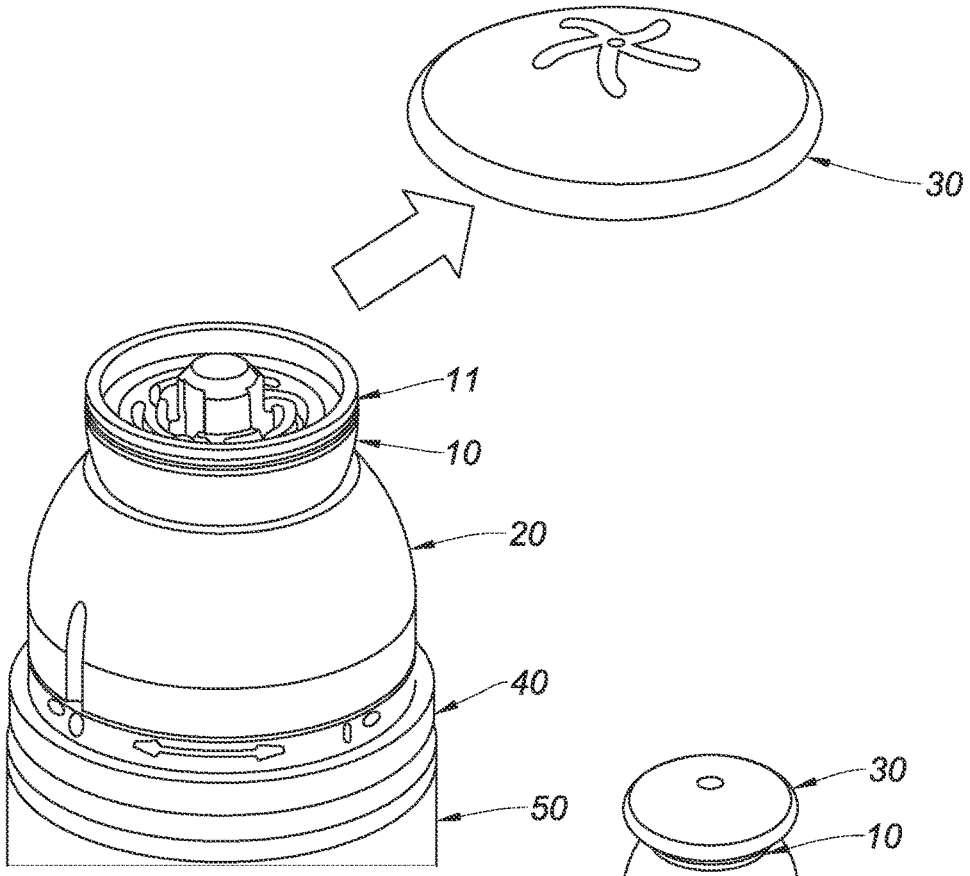
FIG. 5 is an elevated view, slightly inclined, showing the reversible fitting between the device shown in the preceding figures and a second embodiment of the applicator according to the invention.
Figure 6:
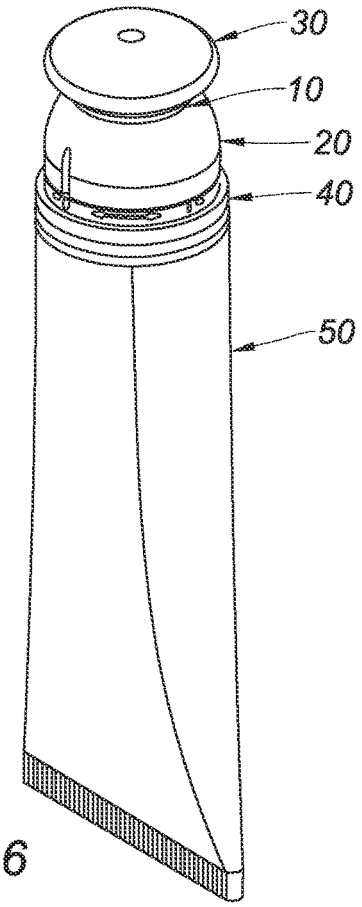
FIG. 6 is an elevated view, slightly inclined, showing an embodiment of a tube for cosmetic product according to the invention.

"Applicator" means a part intended to come into contact with a user's skin. Said part here has an opening capable of allowing the cosmetic product to pass through. Different openings can be provided, including openings of different shapes and dimensions, without departing from the scope of the invention. For example, the opening can be made in the form of a cylindrical channel, or even in the form of a star with branches that may be curved, as shown in FIG. 5.

Figure 3:
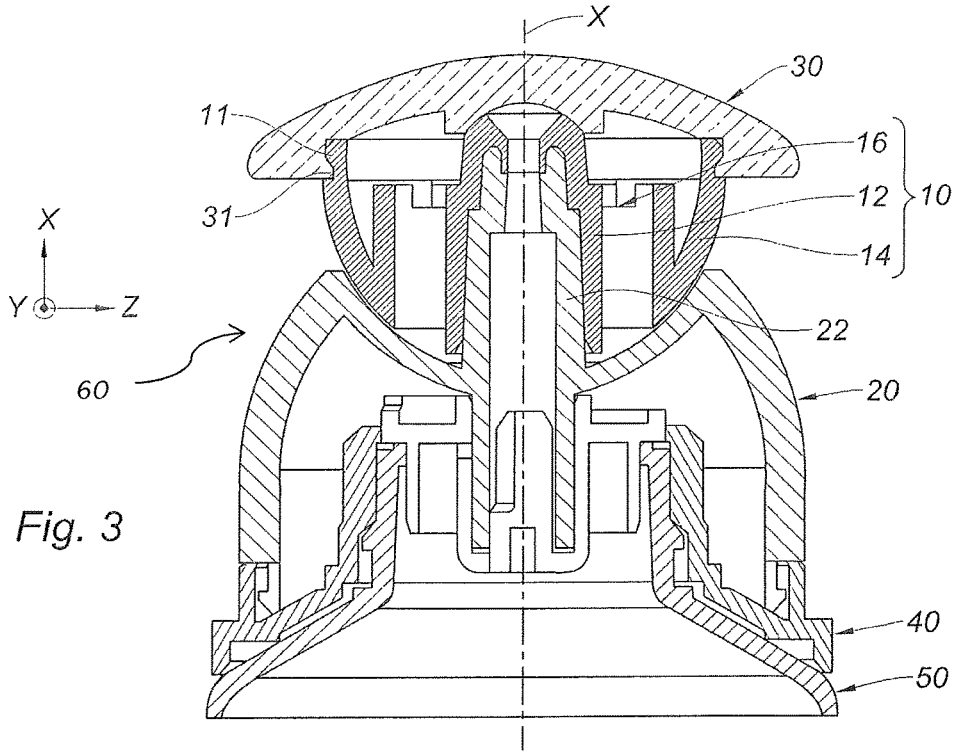
FIG. 3 is a view in longitudinal cross-section of FIG. 1.
Figure 4:
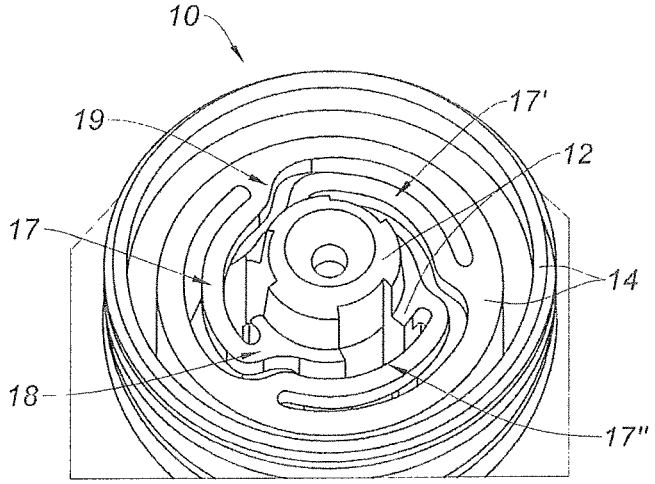
FIG. 4 is a perspective view, slightly inclined, showing a transverse view of the device for connecting the applicator head of FIG. 1.

The connection device 10 of the invention is shown in detail in FIGS. 3 and 4.

Said device 10 comprises a part 12 for fixing to said distributor head, in particular to its base 20, said fixing part 12 being configured to be immovable relative to said distributor head. "Immovable" means a recessing link between the fixing part 12 and said distributor head. This recessing link can be undone; it is produced by cooperation of shapes between the fixing part 12 and said distributor head. More precisely, said fixing part 12 comprises a shaft for insertion of a conduit 22 for passage of said product, said passage conduit 22 being integrated into the base 20 of said distributor head.

The connection device 10 also comprises a part 14 movable relative to said fixing part 12.

The mobility of said movable part 14 is provided by a connection zone 16 between the fixing part 12 and the movable part 14. It is configured so that said movable part 14 is movable in rotation about at least two axes X, Y of a orthonormal coordinate system X, Y, Z relative to said fixing part 12. This orthonormal coordinate system X, Y, Z is shown in FIGS. 1 to 3.

FIGS. 1 and 2 show the device 10 in two different positions, in order to illustrate one of said mobilities, in particular the mobility about the axis Y of said orthonormal coordinate system X, Y, Z. Consequently, it will be said that said movable part 14 is capable of occupying a first position, known as the rest position, illustrated in FIG. 1, and a second position, known as the working position, illustrated in FIG. 2. These rest and working positions are occupied by the movable part 14, in particular relative to said fixing part 12.

The mobility illustrated here is not restrictive, and said movable part 14 can also be movable about the X and/or Z axes without departing from the scope of the invention. Thus, the connection between said movable part 14 and said fixing part 12 can be a ball-joint link about the three directions of said orthonormal coordinate system X, Y, Z.

Since the fixing part 12 is immovable relative to the distributor head by virtue of the recessing link on the passage conduit 22, it will be said that the movable part 14 is in a ball-joint link relative to said distributor head. Taking into account that the applicator 30 is intended to be fitted to the movable part 14 of the connection device 10, it will be said that the applicator 30, integral with said movable part 14, is in a ball-joint link relative to said distributor head. In other words, said connection device 10 makes it possible to orientate said applicator 30 relative to said distributor head about said three axes of rotation X, Y, Z.

It should be noted that said movable part 14 is advantageously configured to allow reversible fitting of the applicator 30 (see FIG. 5). Said reversible fitting here is a locking of the applicator 30 on said movable part 14. This reversible fitting can be produced in any other manner without departing from the scope of the invention. For example, said fitting can be a screwed fitting.

Furthermore, said connection zone 16 comprises a return means 17, 17', 17" configured to exert a restoring force on said movable part 14. This restoring force is intended to bring the movable part 14 from the working position—shown in FIG. 2—towards the rest position—shown in FIG. 1.

This restoring force, exerted by said return means 17, 17', 17", is in opposition to the orientation of the applicator 30 relative to the distributor head. This makes it possible to press said applicator 30 on the skin of a user. In other words, said return means 17, 17', 17" confers on the applicator 30 a capacity for dynamic adaptation to the surface with which it enters into contact, in particular to the curves of said surface. Said surface can be the face of a user, his neck, or even any limb of his body.

As shown in FIG. 4, said return means 17, 17', 17" comprises at least one connector arm 17 with two ends 18, 19. The first of said ends is connected to the fixing part 12 and the second end is connected to the movable part 14. Said connector arm 17 is elastically deformable, especially by virtue of its intrinsic mechanical features, and in particular by virtue of its lamellar form, especially its lamellar spring form.

Advantageously, said return means 17, 17', 17" takes the form of three lamellar arms 17, 17', 17" positioned in a spiral between the fixing part 12 and the movable part 14. Here, the lamellar arms 17, 17', 17" are three in number, without this being restrictive. Multiplying the number of arms 17, 17', 17" makes it possible to give the return means 17, 17', 17" some sturdiness while enabling it to fulfil its function which is similar to that of a return spring. The number of arms can be included in the range between 2 and 6 without departing from the scope of the invention.

It should be noted that said restoring force is exerted in the three dimensions of the orthonormal coordinate system X, Y, Z, in particular in the form of restoring torque.

Said restoring force can also be obtained by any other configurations given to said return means, without departing from the scope of the invention.

As an alternative (not shown), said return means can be produced by an annular zone full of material between said fixing part 12 and said movable part 14, said zone full of material being thin, in the manner of a band of elastic material. Said band of material can be ribbed to provide the function of elastic return from the working position towards the rest position, said ribs then extending, like said lamellar arms 17, 17', 17", between said fixing part 12 and said movable part 14.

The fixing part 12, the movable part 14 and the connection zone 16 are advantageously made in a single part. In the description that follows, said part will be called the articulation part and referenced 60, like said connection device 10.

This single articulation part 60 has the advantage, in itself, of allowing a ball-joint link between the applicator 30 and the distributor head, of ensuring the pressing of said applicator 30 on the skin of a user—in other words, of providing comfort during use as required—and of offering the user the option of changing the applicator 30 according to his requirements/wishes.

It should be noted that the X axis here constitutes a longitudinal axis of extension of said connection device 10. Said fixing part 12 is situated along the length of said longitudinal axis of extension X, and moving radially away from the axis, said connection zone 16 is encountered first and then said movable part 14.

As can be best seen in FIG. 3, said articulation part 60 here has a hemispherical envelope, deformable by virtue of said connection zone 16. The base 20 comprises, at its distal end situated opposite, a recess of complementary shape receiving a lower portion of said articulation part 60. Here, said recess therefore has, in counter-relief, a curved cup shape. Said passage conduit 22 projects from said recess, at its centre. Said recess in the base makes it possible to conceal said lower portion of the articulation part 60. It also has the advantage of guiding said articulation part 60 which will prevent it from being deformed beyond a maximum stress limit.

Said articulation part 60 is a moulded part. It comprises in particular plastic. It can, for example, be moulded from polyoxymethylene (POM). Said articulation part 60 can also be moulded from any other plastic material having a high tensile strength, high fatigue strength and/or high creep strength.

It should be noted that the invention also relates to the distributor head described above. Said distributor head here comprises the opening/closing ring 40 movable in relation to said base 20 of the distributor head, in particular by a rotary movement about said axis X (see positions of the double arrow relative to said axis X in FIGS. 1 and 2). Said ring 40 is capable of occupying a first position, known as the closed position, shown in FIG. 1, and a second position, known as the open position, shown in FIG. 2. This is because it is configured to block the passage of the cosmetic product through said distributor head in the closed position and to allow the passage of said product through said distributor head in the open position. It can be fitted to the tube 50, in particular to its neck.

Said ring 40 has the advantage of performing a sealing function between the distributor head and the applicator 30, in particular by blocking or allowing the passage of the cosmetic product upstream of the passage conduit 22 (see FIG. 3).

The invention also relates to the tube 50 as described above. Said tube 50 will be appropriate for use on the move. It will be appropriate for any type of cosmetic product, make-up as well as cream or dermatological care product for users' skin. It will also be appropriate in the medical field.

As has been described above, the applicator 30 is configured to be fitted reversibly on said articulation part 60 (see also FIG. 5). Furthermore, the applicator 30 has an application surface, which is visible, intended to make contact with a user's skin and an inner surface, which is not visible when the applicator 30 is fitted to said distributor head via said articulation part 60.

Said reversible fitting is provided by the cooperation of at least one shape 11 on said applicator 30 with at least one counter-shape 31 on said movable part 14. An example of such a shape 11 and counter-shape 31 is shown in FIG. 3.

Said shape 11 is, here, a groove 11 which is produced during moulding of the articulation part 60, on the movable part 14, in particular on the outer periphery of the movable part 14.

The counter-shape 31 is, here, a circular hook 31 intended to cooperate with said groove 11. Said hook 31 is flexible. It can extend from the inner surface of the applicator 30, over the entire circumference thereof or partially in the form of a series of separate hooks 31.

As an alternative, not shown, said shape 11 can be a helical thread intended to cooperate with a helical thread produced on the inner surface of said applicator 30.

This reversible fitting of the applicator 30 on said articulation part 60 has several advantages.

It enables the user to clean the applicator 30 after use, for example with clean water, or even using an antiseptic in the case of shared use of said applicator 30.

It enables the shape and texture of said applicator 30 to be adapted to the use. For example, an applicator 30 with a cooling effect can be used to apply an anti-ageing cream below a user's eyes; whereas an applicator 30 with a massaging effect will be used to apply the same anti-ageing cream to the rest of the face of the same user.

Said reversible fitting also has an advantage when applicator heads comprising said articulation part 60 are sold. This is because a single applicator head can be used for different fields of application, without the need to provide a specific applicator head for each of said different fields of application.

It should be noted that said reversible fitting will be designed so as to preserve the mobility provided by said connection zone 16 between the fixing part 12 and the movable part 14.

Said reversible fitting therefore has the advantage of not affecting said mobility provided by said connection zone 16 between the fixing part 12 and the movable part 14.

It should also be noted that said reversible fitting will be designed so as to protect the return means 17, 17', 17" configured to exert the restoring force on said movable part 14.

Said reversible fitting therefore has the advantage of not damaging/ruining the return function provided by the return means 17, 17', 17".

It should further be noted that said applicator 30 is advantageously a moulded part, preferably of plastic. Said applicator 30 can be flocked, in particular using cotton, without departing from the scope of the invention.

It should also be noted that variant embodiments are of course possible. In particular, it is also conceivable, in additional embodiments, that the articulation part 60 is made by over-moulding with a connection zone 16 provided in a different material from the material(s) used for the fixing part 12 and the movable part 14, for example said connection zone 16 will be made in an elastomer material.

The invention claimed is:

1. Connection device between a distributor head for cosmetic product and a cosmetic product applicator, said device comprising a part for fixing to said distributor head, said fixing part being configured to be immovable relative to said distributor head, and a part movable relative to said fixing part, said device further comprising a connection zone between the fixing part and the movable part, said connection zone being configured so that said movable part is movable in rotation about at least two axes (X, Y, Z) of a orthonormal coordinate system (X, Y, Z) relative to said fixing part.

2. Connection device according to claim 1, wherein said movable part is capable of occupying a first position, known as the rest position, and a second position, known as the working position, relative to said fixing part, said connection zone comprising a return means configured to exert a restoring force on said movable part in such a way as to bring it back from the working position towards the rest position.

3. Connection device according to claim 2, wherein said return means comprises at least one connector arm having two ends, the first of said ends being connected to the fixing part and the second end being connected to the movable part, said connector arm being elastically deformable.

4. Connection device according to claim 1, wherein said movable part is configured to allow reversible fitting of the applicator.

5. Connection device according to claim 4, wherein said movable part is configured to allow locking of the applicator.

6. Connection device according to claim 1, wherein the fixing part, the movable part and the connection zone are made in a single part, known as an articulation part.

7. Connection device according to claim 6, wherein said articulation part comprises some plastic.

8. Applicator head for cosmetic product comprising a distributor head, an applicator and a device according to claim 1.

9. Tube for cosmetic product comprising an applicator head according to claim 8.

10. Applicator for applicator head according to claim 8, said applicator being configured to be fitted reversibly to said connection device.

* * * * *